US011389047B2

(12) United States Patent
Singhal et al.

(10) Patent No.: US 11,389,047 B2
(45) Date of Patent: Jul. 19, 2022

(54) DISHWASHER RACK SUPPORT ASSEMBLY

(71) Applicant: Haier US Appliance Solutions, Inc., Wilmington, DE (US)

(72) Inventors: Arpit Singhal, Utter Pradesh (IN); Justin Paul Mudd, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 160 days.

(21) Appl. No.: 16/930,545

(22) Filed: Jul. 16, 2020

(65) Prior Publication Data

US 2022/0015605 A1 Jan. 20, 2022

(51) Int. Cl.
*A47L 15/50* (2006.01)

(52) U.S. Cl.
CPC ..... *A47L 15/507* (2013.01)

(58) Field of Classification Search
CPC ..... A47L 15/507
See application file for complete search history.

(56) References Cited

U.S. PATENT DOCUMENTS

| | | | | |
|---|---|---|---|---|
| 3,228,739 | A * | 1/1966 | Jordan | A47L 15/507 312/334.33 |
| 3,347,612 | A * | 10/1967 | Bebinger | A47L 15/507 312/334.42 |
| 4,362,346 | A * | 12/1982 | Emmert | A47B 88/487 312/334.12 |
| 9,345,382 | B2 | 5/2016 | Carr | |
| 9,723,970 | B1 * | 8/2017 | Carr | A47L 15/507 |
| 2008/0035186 | A1 * | 2/2008 | Wegener | A47L 15/507 134/143 |
| 2008/0156358 | A1 * | 7/2008 | Shin | A47L 15/502 134/137 |
| 2017/0202428 | A1 * | 7/2017 | Kumar | A47L 15/506 |

FOREIGN PATENT DOCUMENTS

DE 102010043268 A1 5/2012

* cited by examiner

*Primary Examiner* — Benjamin L Osterhout
(74) *Attorney, Agent, or Firm* — Dority & Manning, P.A.

(57) ABSTRACT

A dishwasher appliance includes a rack support assembly for supporting a rack within a wash chamber and on a dishwasher door. The rack support assembly may include one or more roller assemblies that support the rack on a tub track or a door track. The rack support assembly may further include one or more rigid studs, each rigid stud paired with a roller assembly, for supporting the rack on the door track when its corresponding roller assembly is between the tub track and the door track.

20 Claims, 6 Drawing Sheets

DISHWASHER RACK SUPPORT ASSEMBLY

FIELD OF THE INVENTION

The present subject matter relates generally to rack support assemblies for dishwasher appliances, and more particularly, to support assemblies allowing a rack to transition between the interior and the exterior of the appliance without significant jarring of the rack and its contents.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Conventional dishwasher appliances include rack support assemblies for supporting racks within the wash chamber. These rack support assemblies permit a user to slide the rack out from the wash chamber and onto the opened dishwasher door for emptying and loading dishes into the wash chamber for running a wash cycle. Typical racks are slidable into and out of the wash chamber between cycles for removing and loading dishes but rely on roller assemblies to achieve such movement. Particularly, carrier roller assemblies are typically mounted to the rack and include a plurality of rollers that roll along the dishwasher door which opens to a horizontal position. Notably, however, to travel between the wash chamber and the door, the carrier roller assemblies must traverse a gap between tracks within the wash chamber and tracks on the door. Conventional carrier roller assemblies typically sink into this gap and then climb the opposite side, jarring the rack and its contents. This jarring transition may cause damage to delicate dishes or at least the perception of damage among users, which decreases satisfaction with the appliance. Moreover, conventional carrier roller assemblies are expensive, both in terms of the component parts and the time necessary to assemble the many parts which comprise them. As a result, manufacturing complexity is increased, part procurement and storage are complicated, and appliance assembly is complex and costly.

Accordingly, a dishwasher appliance that utilizes an improved rack support assembly would be useful. More specifically, a rack support assembly that prevents jarring or "jumps" of the rack as it transitions to a door would be desirable. Additionally or alternatively, support assemblies that are cheaper or more efficient that existing assemblies would be advantageous.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance is provided. The dishwasher appliance defines a vertical, a lateral, and a transverse direction. The dishwasher appliance further comprises a wash tub, a rack, a door, and a rack support system. The wash tub defines a wash chamber for receipt of articles for washing. The rack is slidably positioned within the wash chamber and configured for movement along the transverse direction between a recessed position and an extended position. The door is rotatably mounted to the wash tub for providing selective access to the wash chamber. The rack support system further comprises a door track attached to the door, a tub track attached to the wash tub, a roller assembly, and a rigid stud. The roller assembly includes a wheel for supporting the rack on the tub track in the recessed position and on the door track in the extended position. The rigid stud supports the rack when the roller assembly is between the tub track and the door track.

In a second example embodiment, a rack support system is provided. The rack support system comprises a rack, a door track, a tub track, a roller assembly, and a rigid stud. The roller assembly includes a wheel for support of the rack on the tub track and on the door track. The rigid stud supports the rack when the roller assembly is between the tub track and the door track.

BRIEF DESCRIPTION OF THE DRAWINGS

A full and enabling disclosure of the present subject matter, including the best mode thereof, directed to one of ordinary skill in the art, is set forth in the specification, which makes reference to the appended figures.

Figure 1:
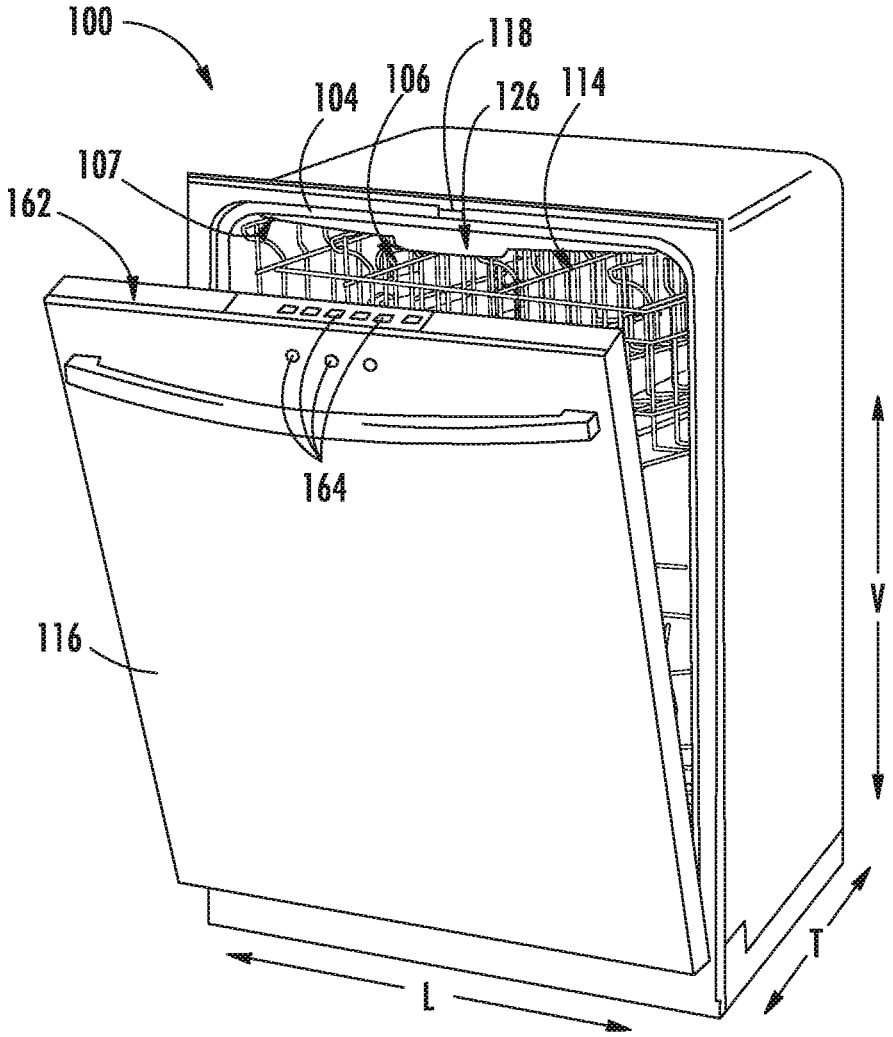
FIG. 1 is a front perspective view of a dishwasher appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. Furthermore, as used herein, terms of approximation, such as "approximately," "substantially," or "about," refer to being within a ten percent margin of error.

Figure 2:
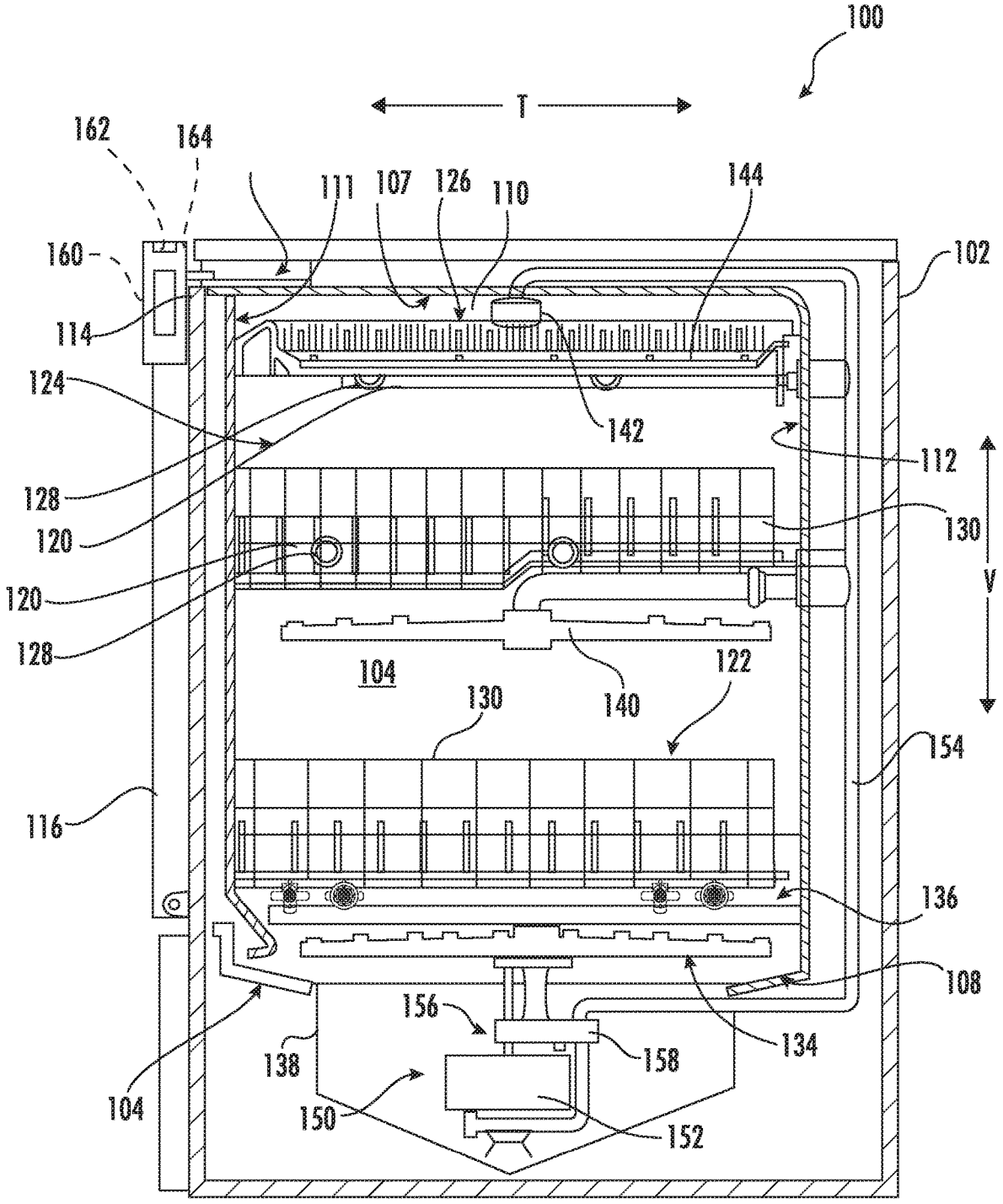
FIG. 2 is a side, cross sectional view of the exemplary dishwasher appliance of FIG. 1.
Figure 4:
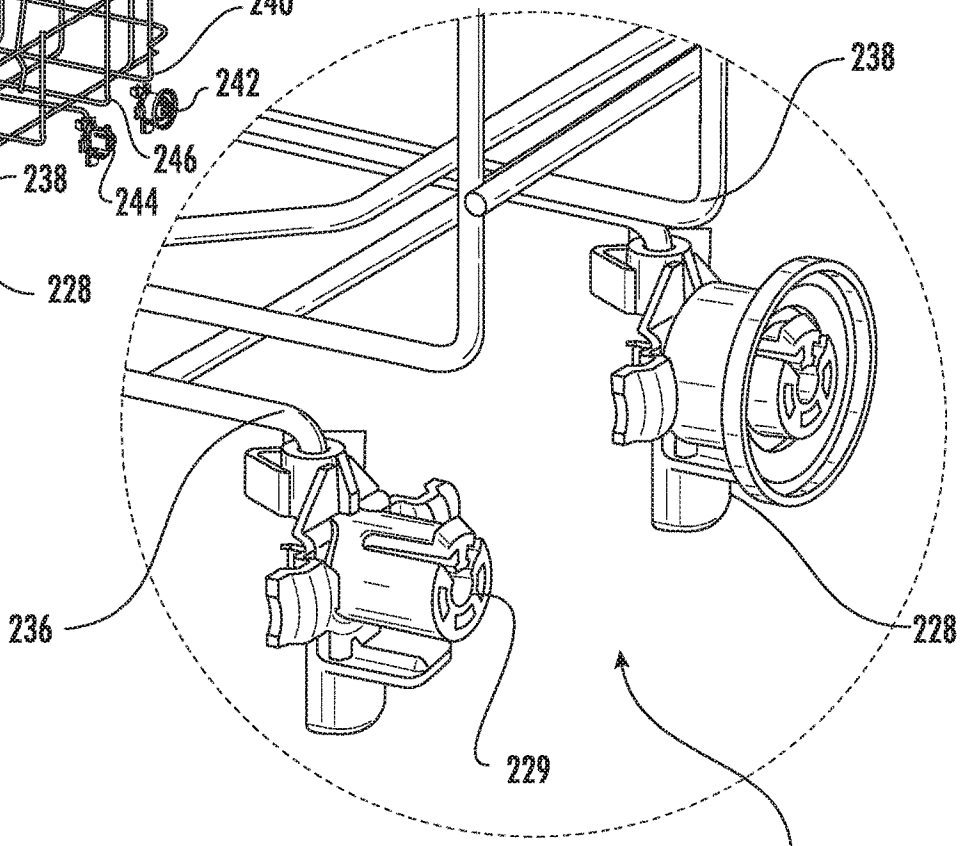
FIG. 4 is a magnified perspective view of rigid stud and roller assembly in accordance with an embodiment of the present subject matter.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, a lower rack assembly 122, a middle rack assembly 124, and an upper rack assembly 126 are stacked along the vertical direction V within wash chamber 106. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. With respect to middle rack assembly 124 and upper rack assembly 126, this is facilitated, for example, by guide rails 120 which are mounted to side walls 110 and rollers 128 mounted onto rack assemblies 124, 126, respectively. Although guide rails 12 and rollers 128 are illustrated herein as facilitating movement of the respective rack assemblies 124 and 126, it should be appreciated that any suitable sliding mechanism or member may be used to facilitate movement of middle rack assembly 124 and upper rack assembly 126 according to alternative embodiments. In addition, as will be described in more detail below, lower rack assembly 122 may include a rack support system 224 including one or more roller assemblies 228 and rigid studs 229 which slidably support lower rack assembly 122, thereby permitting the lower rack to roll out of wash chamber 106 and rest on door 116 when it is in the open (i.e., substantially horizontal) position.

Some or all of the rack assemblies 122, 124, 126 are fabricated into wire racks constituting lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. In some embodiments, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 may draw wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 may be further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Referring now generally to FIGS. 3 through 7, various views of a rack support system 224 (e.g., supporting a rack 222) are provided. Rack 222 may be attached to one or more roller assemblies 228 and rigid studs 229. In some embodiments, rack 222 may include or be provided as lower rack 130 (FIG. 1), as discussed above. In some embodiments, each roller assembly 228 is paired with a rigid stud 229. For instance, in the embodiment of FIG. 3, in addition to the pairing of roller assembly 228 and rigid stud 229, a second pairing of a second roller assembly 246 and a second rigid stud 244 is shown attached on a near side of rack 222. Additional pairings may also be disposed on the opposite side of rack 222 to distribute the load exerted by rack 222 and its contents. In one embodiment, four roller assembly 228 and rigid stud 229 pairings are attached to rack 222 and situated at the corners of rack 222. Of course, rack support systems employing a different quantity and distribution of roller assemblies 228 and rigid studs 229 may be employed within the scope of the invention.

Figure 5:
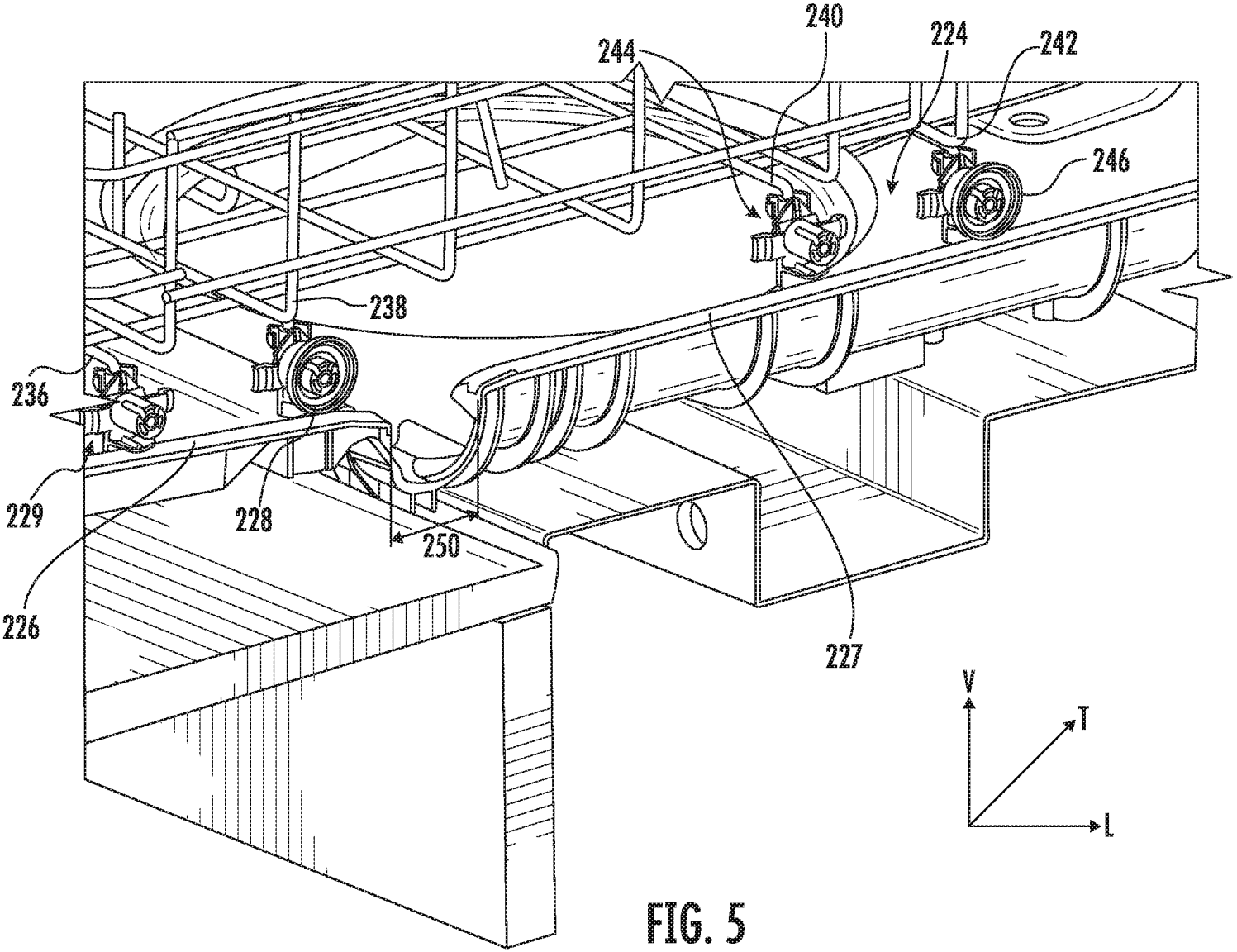
FIG. 5 is a perspective view of a rack support assembly as the rack transitions between a recessed position and an extended position in accordance with an embodiment of the present subject matter.

As further shown in FIG. 5, rack support system 224 may further include a door track 226 extending along door 116 perpendicular to the lateral direction. Door track 226 may be attached to or integral with door 116. Further door track 226 is raised from the surface of door 116 such that the surface of door 116 and the parallel surface of door track 226 are spaced apart from one another, creating a lip or ridge on door 116. When door 116 slides out of the wash chamber 106 to an extended position at least partially above door 116, door track 226 may support one or more of roller assemblies 228 and 246 and/or one or more of rigid studs 229 and 244. A second parallel door track may be employed at the same height on the opposite side of door 116 to employ roller assemblies and rigid studs on that side of rack 222 as well. In embodiments employing additional roller assemblies and rigid studs, door track 226 would likewise support those as well. The roller assemblies 228 and 246 and rigid studs in turn support the rack 222 and its contents.

Also shown in FIG. 5, rack support system 226 may further include a tub track 227 extending along wash tub 104 in the transverse direction. Tub track 227 may be attached or integral with wash tub 104. As with door track 226, tub track 227 may be raised from the bottom 108 of wash tub 104, forming a lip or ridge in wash tub 104. When door 116 slides into wash chamber 106, it is in a recessed position. In the recessed position, roller assemblies 228 and 246 are supported by tub track 227. A second parallel tub track may be employed at the same height on the opposite side of wash tub 104 to support roller assemblies on that side of rack 222 as well. Furthermore, roller assemblies 228 and 246 support rack 222 and its contents in this recessed position. In embodiments employing additional roller assemblies, those roller assemblies would also be supported by tub track 227 and support rack 222 and its contents.

Generally, it is desirable that, when door 116 is rotated to the open position, door tracks 226 and tub tracks 227 are aligned along a common axis parallel to the transverse direction T. During use, such as when the rack 222 is moved between the extended and retracted positions, rigid stud 229 may at least partially support rack 222 as roller assembly 228 transitions between tub track 227 and door track 226 and vice versa.

Figure 6:
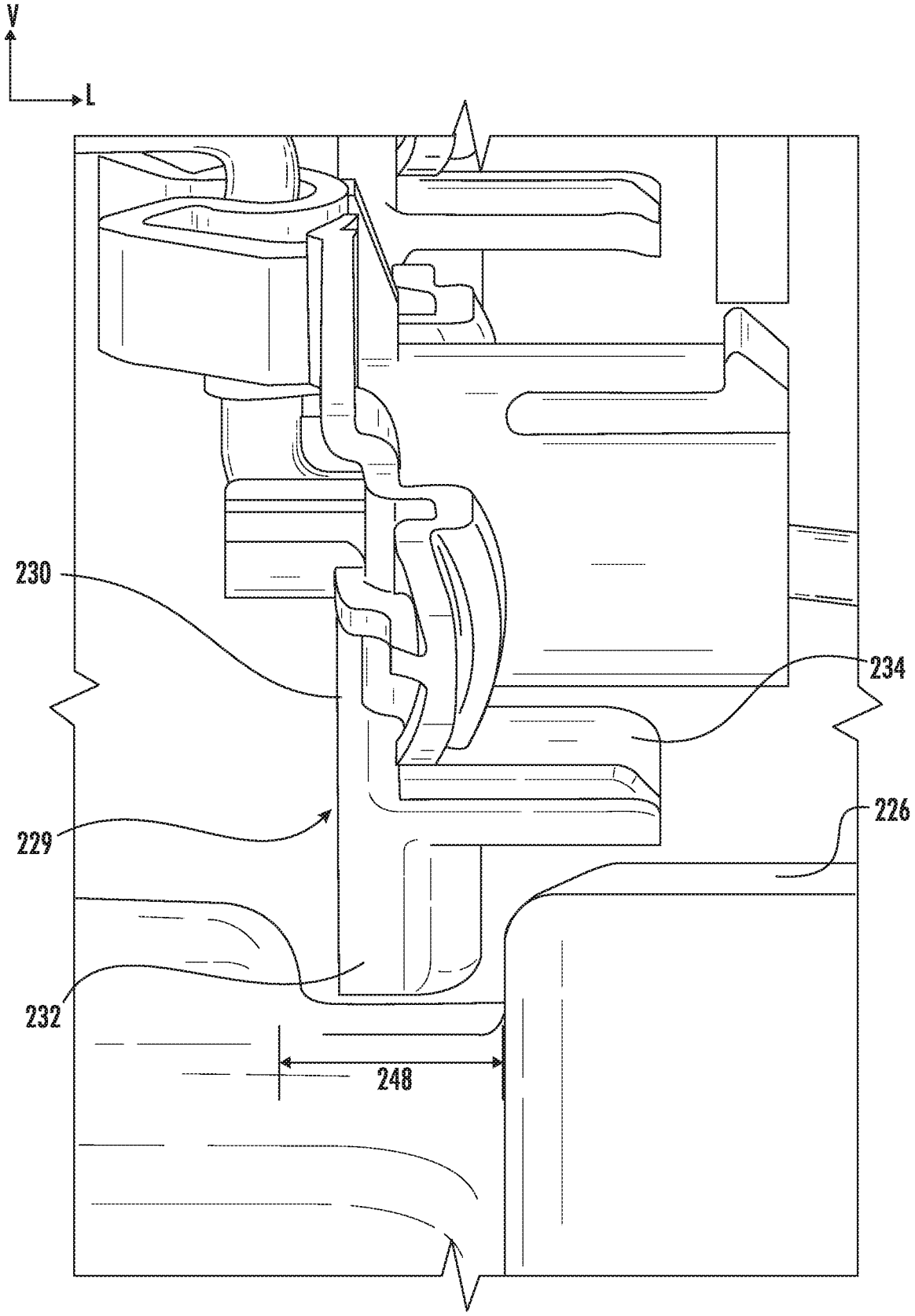
FIG. 6 is a front view of a rigid stud interacting with a door track in accordance with an embodiment of the present subject matter.

Specifically, as shown in FIG. 6, in some embodiments rigid stud 229 comprises a body 230, a guide protrusion 232, and a support protrusion 234. Support protrusion 234 extends laterally from body 230 and may be a separate component joined to body 230 in certain embodiments or may be integral with body 230 in other embodiments. Support protrusion 234 may be aligned above door track 226 and may provide support for rack 222 when roller assembly 228 is between door track 226 and tub track 227. As rack 222 transitions from the recessed position to the extended position and vice versa, support protrusion 234 travels over and above either door track 226 or tub track 227. When roller assembly 228 enters a gap 250 between door track 226 or tub track 227, rack support system 224 lowers slightly until support protrusion 234 makes contact with either door track 226 or tub track 227, as further described below. Advantageously, this support substantially limits roller assembly 228 from sinking into gap 250 between tub track 227 and door track 226, thereby reducing the impact of roller assembly 228 against tub track 227 or door track 226 once gap 250 is bridged.

As further shown in the embodiment of FIG. 6, rigid stud 229 comprises guide protrusion 232. Guide protrusion 232 extends generally downward from body 230, defining the portion of rigid stud 229 and below support protrusion 234. Rigid stud 229 of rack support system 224 is configured such that at least a portion of guide protrusion 232 extends to a side of tub track 227 when rack 222 is in the recessed position and to a side of door track 226 when rack 222 is in the extended position. Guide protrusion 232 slides along a side of tub track 227 when rack 222 is in the recessed position and along a side of door track 226 when rack 222 is in the extended position. Thus, guide protrusion 232 limits lateral movement of rack 222 against door track 226 and tub track 227. When paired with a rigid stud 229 having a guide protrusion 232 on the opposite side of the rack, movement of rack 222 in both lateral directions is limited, thus maintaining the position of rack 222 between door tracks 226 or tub tracks 227. In one embodiment, guide protrusion 232 may be configured to slide along an inside of door track 226 or tub track 227. In another embodiment, guide protrusion 232 may be configured to slide along an outside of door track 226 or tub track 227. Either configuration is effective so long as the same configuration is used on both lateral sides of rack 222.

Figure 7:
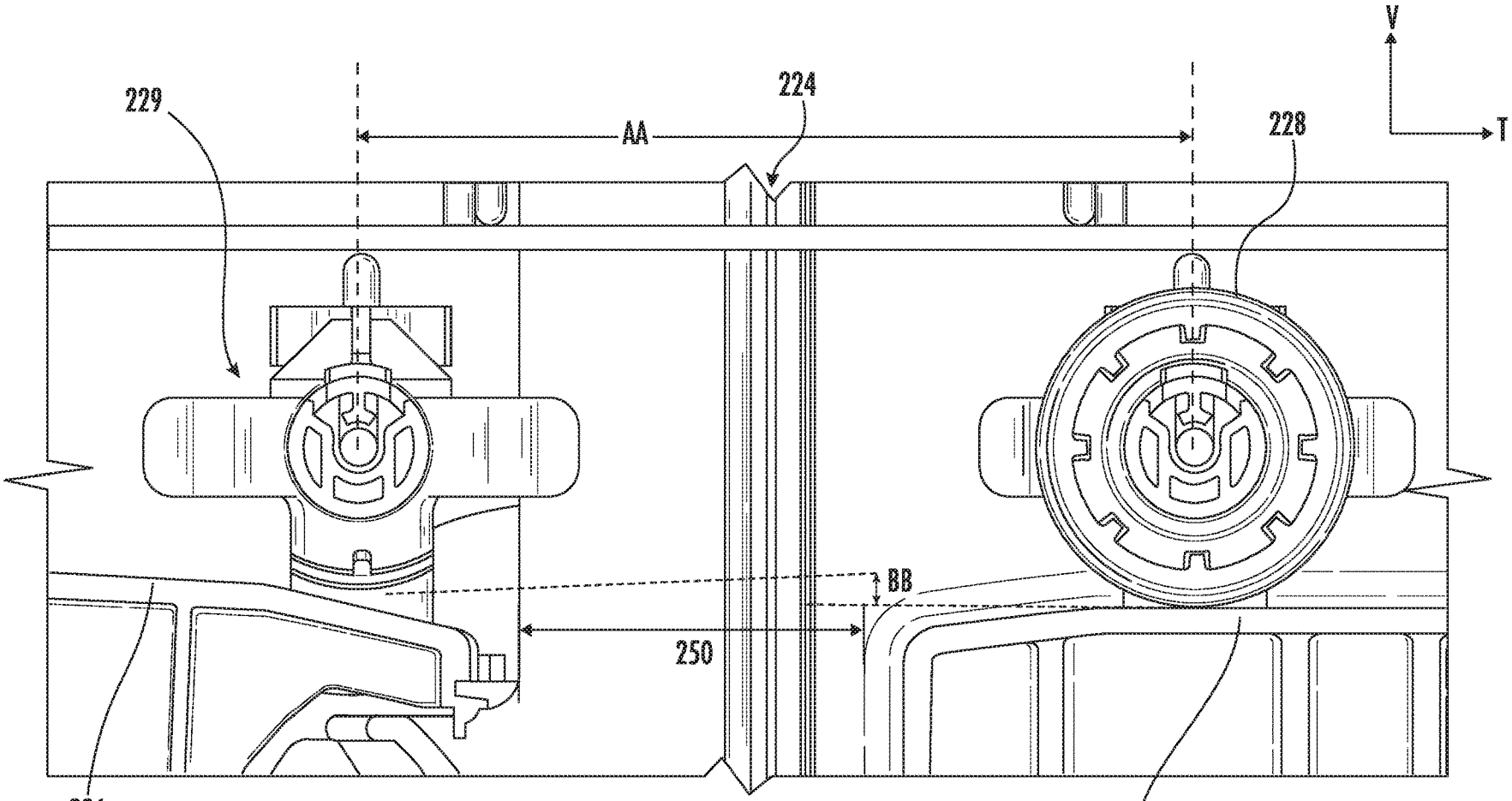
FIG. 7 is a side view of a rack support assembly in accordance with an embodiment of the present subject matter.

Generally, it is desirable that rack 222 is supported at least in part by roller assemblies 228, as roller assemblies 228 provide smoother movement or reduced friction (e.g., compared to rigid studs 229) as rack 222 moves in the transverse direction T. Thus, roller assemblies 228 may at least partially support rack 222 when rack 222 is in the recessed position and the extended position. However, when rack 222 is in transition and roller assembly 228 is between door track 226 and tub track 227, rack 222 may be at least partially supported by rigid stud 229. This may be accomplished by ensuring that the bottom of a wheel 231 of roller assembly 228 (shown in FIG. 4) is slightly lower than support protrusion 234 of rigid stud 229. That is, the vertical distance between the bottom of rack 222 and the bottom of wheel 231 should exceed the vertical distance between the bottom of rack 222 and the bottom of support protrusion 234. The difference in these distances is the distance BB between the bottom of wheel 231 and the bottom of support protrusion 234 (FIG. 7). In this way, support protrusion 234 will not contact door track 226 or tub track 227 so long as wheel 231 is in such contact.

When rack 222 is slid between the recessed position and the extended position, wheel 231 may cease to be in contact with either door track 226 or tub track 227. At this point, rack 222 may lower slightly until support protrusion 234 comes in contact with door track 226, limiting the depth to which rack 222 is lowered. This added support may require that the transverse distance AA (FIG. 7) between roller assembly 228 and rigid stud 229 must exceed the transverse distance between door track 226 and tub track 227.

In some embodiments, support protrusion 234 defines a bottom curved surface in selective contact with the door track, as shown in the embodiment of FIG. 6. The curved support protrusion 234 ensures that door track 226 does not catch on a flat edge of support protrusion 234, reducing the force of any impact when support protrusion 234 comes into contact with door track 226 and minimizing the surface area of support protrusion 234 in contact with door track 226 for smoother movement of rack 222.

In another embodiment, when door 116 is the open position, a rearward end of door track 226 may be angled downward toward wash tub 104 and a forward end of tub track 227 may be angled downward toward door 116 as shown in the embodiment of FIG. 7. Such a configuration provides a more gradual transition for wheel 231 as it traverses gap 250 between door track 226 and tub track 227, thus minimizing the impact when wheel 231 reestablishes contact and limiting the degree of jarring to rack 222 and its contents.

Figure 3:
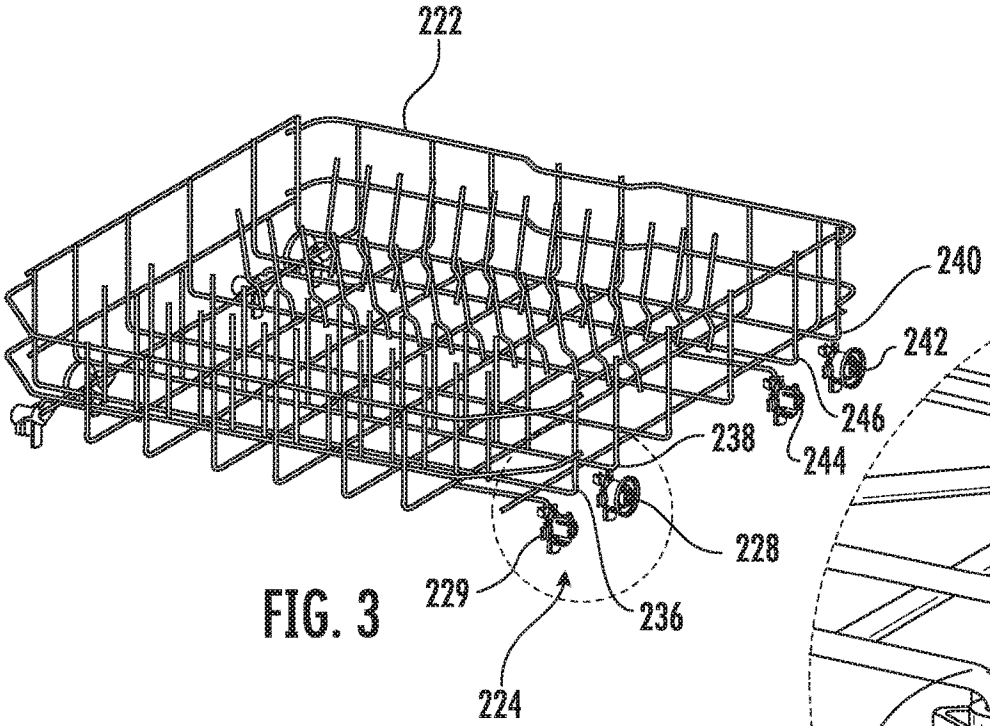
FIG. 3 is a perspective view of a rack employing a rigid stud and roller assembly in accordance with an embodiment of the present subject matter.

Optionally, as shown in the embodiment of FIG. 3, rack 222 may be a wire rack having multiple wire rows extending laterally across rack 222. As shown in the embodiment of FIG. 3, rack 222 may include a first wire row 236, a second wire row 238 rearward from first wire row 236, a third wire row 240 rearward from second wire row 238, and a fourth wire row 242 rearward from third wire row 238, each of first wire row 236, second wire row 238, third wire row 240, and fourth wire row 242 extending laterally across the rack. In certain embodiments, rigid stud 229 and roller assembly 228 are attached to rack 222 in alternating order at each wire row. For example, rigid stud 229 may be attached to rack 222 at first wire row 236 and roller assembly 228 may be attached to rack 222 at second wire row 238. In further embodiments, a second rigid stud 244 may be attached to rack 222 at third wire row 240 and a second roller assembly 246 may be attached to rack 222 at a fourth wire row 242. Of course, one of ordinary skill will recognize that this configuration is not required to come within the scope of the invention. In alternative embodiments, roller assemblies 228 may be closer to door 116 than rigid studs 229 and thus may swap wire rows at which they are attached. In yet other embodiments, the front set of rigid stud 229 and roller assembly 228 may be arranged in a different order than the back set (or any set in between).

As shown in the embodiment of FIG. 6, a lead-in gap 248 in door 116 adjacent to door track 226 may be used to accommodate guide protrusion 232. Absent such a gap, guide protrusion 232 may contact door 116 creating a hard stop and jarring rack 222 and its contents. Lead-in gap 248 should be sized such that guide protrusion 232 may pass through lead-in gap 248 when support protrusion 234 comes into contact with door track 236. In this way, guide protrusion 232 will not interfere with the smooth transition of rack 222 from the recessed position to the extended position and vice versa.

Additionally or alternatively, the present rack system 224 may advantageously prevent the rack 222 from being jarred or jumping as the rack 222 transitions between the extended and retracted positions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical, a lateral, and a transverse direction, the dishwasher appliance comprising:

a wash tub that defines a wash chamber for receipt of articles for washing;

a rack slidably positioned within the wash chamber and configured for movement along the transverse direction between a recessed position and an extended position;

a door rotatably mounted to the wash tub for providing selective access to the wash chamber; and a rack support system comprising:

a door track extending along the door perpendicular to the lateral direction;

a tub track extending along the wash tub in the transverse direction; and a roller assembly attached to the rack, the roller assembly including a wheel disposed above the tub track for supporting the rack on the tub track in the recessed position and on the door track in the extended position; and a rigid stud attached to the rack configured for slidably supporting the rack when the roller assembly is between the tub track and the door track.

2. The dishwasher appliance of claim 1, wherein a transverse distance between the roller assembly and the rigid stud exceeds a transverse distance between the door track and the tub track.

3. The dishwasher appliance of claim 2, wherein the rack is a wire rack having a first wire row, a second wire row rearward from the first wire row, a third wire row rearward from the second wire row, and a fourth wire row rearward from the third wire row, each of the first wire row, the second wire row, the third wire row, and the fourth wire row extending laterally across the rack.

4. The dishwasher appliance of claim 3, wherein the rigid stud is attached to the rack at the first wire row and the roller assembly is attached to the rack at the second wire row.

5. The dishwasher appliance of claim 4, wherein a second rigid stud is attached to the rack at the third wire row and a second roller assembly is attached to the rack at the fourth wire row.

6. The dishwasher appliance of claim 1, wherein the rigid stud comprises:

a body;

a support protrusion extending laterally from the body; and a guide protrusion extending downward from the body below the support protrusion.

7. The dishwasher appliance of claim 6, wherein a vertical distance between the rack and a bottom of the wheel exceeds a vertical distance between the rack and a bottom of the support protrusion.

8. The dishwasher appliance of claim 7, wherein the support protrusion defines a bottom curved surface in selective contact with the door track.

9. The dishwasher appliance of claim 6, wherein at least a portion of the guide protrusion extends to a side of the door track in the extended position to limit lateral movement of the rack against the door track.

10. The dishwasher appliance of claim 1, wherein the door is rotatable between an open position and a closed position, wherein a rearward end of the door track is angled downward toward the wash tub in the open position, and wherein a forward end of the tub track is angled downward toward the door.

11. A dishwasher rack support system comprising:

a door track;

a tub track extending along a common axis with the door track and separated from the door track by a gap;

a rack slidably disposed above one or more of the door track and the tub track;

a roller assembly attached to the rack, the roller assembly including a wheel disposed above one of the door track or the tub track for supporting the rack on the tub track or on the door track; and a rigid stud attached to the rack, at least a portion of the rigid stud disposed above one of the tub track or the door track configured for slidably supporting the rack when the roller assembly is in the gap between the tub track and the door track.

12. The dishwasher rack support system of claim 11, wherein the distance between the roller assembly and the rigid stud exceeds the distance between the door track and the tub track along the common axis of the door track and tub track.

13. The dishwasher rack support system of claim 12, wherein the rack is a wire rack having a first wire row, a second wire row rearward from the first wire row, a third wire row rearward from the second wire row, and a fourth wire row rearward from the third wire row, each of the first wire row, the second wire row, the third wire row, and the fourth wire row extending laterally across the rack.

14. The dishwasher rack support system of claim 13, wherein the rigid stud is attached to the rack at the first wire row and the roller assembly is attached to the rack at the second wire row.

15. The dishwasher rack support system of claim 14, wherein a second rigid stud is attached to the rack at the third wire row and a second roller assembly is attached to the rack at the fourth wire row.

16. The dishwasher rack support system of claim 11, wherein the rigid stud comprises:

a body;

a support protrusion extending laterally from the body; and a guide protrusion extending downward from the body below the support protrusion.

17. The dishwasher rack support system of claim 16, wherein a vertical distance between the rack and a bottom of the wheel exceeds a vertical distance between the rack and a bottom of the support protrusion.

18. The dishwasher rack support system of claim 17, wherein the support protrusion defines a bottom curved surface in selective contact with the door track.

19. The dishwasher rack support system of claim 16, wherein at least a portion of the guide protrusion extends to a side of the door track or the tub track to limit movement of the rack perpendicular to the axis of the door track and the tub track.

20. The dishwasher rack support system of claim 11, wherein a rearward end of the door track is angled downward toward the tub track and a forward end of the tub track is angled downward toward the door track.

* * * * *